United States Patent [19]

Cohen

[11] Patent Number: 4,655,354

[45] Date of Patent: Apr. 7, 1987

[54] FOLDABLE DISPLAY RACK

[76] Inventor: Maurice Cohen, 45 Shore Dr. North, Miami, Fla. 33133

[21] Appl. No.: 803,096

[22] Filed: Nov. 27, 1985

[51] Int. Cl.[4] ..... A47F 43/00

[52] U.S. Cl. ..... 211/199; 211/201; 211/207

[58] Field of Search ..... 211/199, 195, 201, 132, 211/174, 172, 207, 13, 60.1; 248/167, 436

[56] References Cited

U.S. PATENT DOCUMENTS

| | | | |
|---|---|---|---|
| 293,847 | 2/1884 | Bremer | 248/167 |
| 742,394 | 10/1903 | Churchill | 211/199 |
| 1,361,464 | 12/1920 | Hunt | 248/436 X |
| 4,285,163 | 8/1981 | Booker, Jr. | 211/195 |
| 4,361,241 | 11/1982 | Stoddard | 211/123 |
| 4,380,298 | 4/1983 | Harig | 211/189 |

FOREIGN PATENT DOCUMENTS

| | | | |
|---|---|---|---|
| 580789 | 9/1946 | United Kingdom | 211/178 |

*Primary Examiner*—Ramon S. Britts
*Assistant Examiner*—Sarah A. Lechok Eley
*Attorney, Agent, or Firm*—Salter & Michaelson

[57] ABSTRACT

A preassembled, foldable display rack that is movable to and from an open display position and a folded closed position without the assembly or disassembly of any of the component parts thereof, the display rack including a plurality of vertical support members that are pivotally interconnected by cross members, the cross members to which the vertical support members are secured defining a parallelogram and being pivotally movable from the folded closed position to the open display position, each of the cross members having a flexible pad located in an end thereof that is engageable with an adjacent cross member so that when the cross members are pivotally moved from the folded closed position to the open display position, the flexible pads frictionally engage the adjacent cross members to lock the cross members and support members to which they are joined in the open display position.

9 Claims, 9 Drawing Figures

FOLDABLE DISPLAY RACK

BACKGROUND OF THE INVENTION

The present invention relates to a foldable display rack on which a plurality of articles are mounted for display thereon. More particuarly, the present invention relates to an assembled display rack that is movable to and from an open or display position and a folded closed position without the assembly or disassembly of any of the component parts thereof.

The rack that is the subject matter of the present invention has particular use in the display of articles of clothing thereon, although it is contemplated that the rack be used to display a variety of articles desired.

Garment display racks and the like are normally constructed such that the component parts thereof are shipped in a knocked-down disassembled position, since it is impractical for the manufacturer to ship the racks to customers in a set-up or open position because of the size and bulk of the racks. Although manufacturers of display racks usually provide sufficient instructions for assembling their racks at the place of use, it is sometimes difficult for the person who assembles the rack components to fit the parts together; and unless the proper tools are used, the rack as assembled will often times be unstable and will not adequately support the intended load of garments thereon. Further, considerable time and effort must be devoted to assembling each of the prior known garment display racks as purchased; and if for any reason the manufacturer of the rack neglectfully includes a component that does not precisely fit into the assembly, the assembly operation is rendered more difficult, usually to the extreme frustration and disatisfaction of the user.

In a general sense, some efforts have been made heretofore to construct racks and the like in a partial knocked-down position for shipping to a point of use, whereafter the partially assembled parts are assembled into a complete unit. Even in these prior known racks, it was always necessary to include some individual parts that had to be mounted in the assembly through the use of screws, bolts or the like. In any event, the prior known knockeddown display devices always required some form of assembly of the component parts through the use of connection members, bolts, screws and the like.

The purpose of this invention is to completely avoid the use of separate connection members and/or fasteners and to enable the user to locate the display rack in a set-up and open display position in a matter of seconds after the removal of the folded rack from its shipping carton.

SUMMARY OF THE INVENTION

The present invention relates to a preassembled, foldable display rack that is movable to and from a set-up display position and a folded or closed position without the requirement of assembling or disassembling of any of the component parts thereof. The foldable display rack of the subject invention includes a plurality of vertical support members, each of which has a display member for receiving articles for display thereon and that is located at the upper end thereof, foot members being located at the lower ends of the support members and cooperating to define a stand. A horizontal cross member is fixed to each of the support members at the upper end thereof and extends at right angles with respect thereto. The end of each cross member that is located opposite to the fixed end thereof is pivotally connected to a cross member adjacent to its fixed end, and a resilient pad is mounted in the free pivotal end of each of the cross members, whereby when the cross members are pivotally movable from a collapsed position in which the pads are located in non-engaging relation with respect to an adjacent cross member to a set-up display position, each of the pads is disposed in frictional engaging relation with respect to the adjacent cross member to lock said cross members in the setup display position, in which position, each of the cross members is disposed at right angles relative to an adjacent cross member. Thus, the display rack of the subject invention is transferred by a simple movement from the folded closed position to an open display position without the requirement for use of any nuts, bolts or other fastening elements.

Accordingly, it is an object of the present invention to provide a preassembled, foldable display rack that is movable to and from a set-up display position and a folded closed position without the assembly or disassembly of any component parts thereof, and without the use of any tooling for locking the component parts of the rack in the assembled position.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
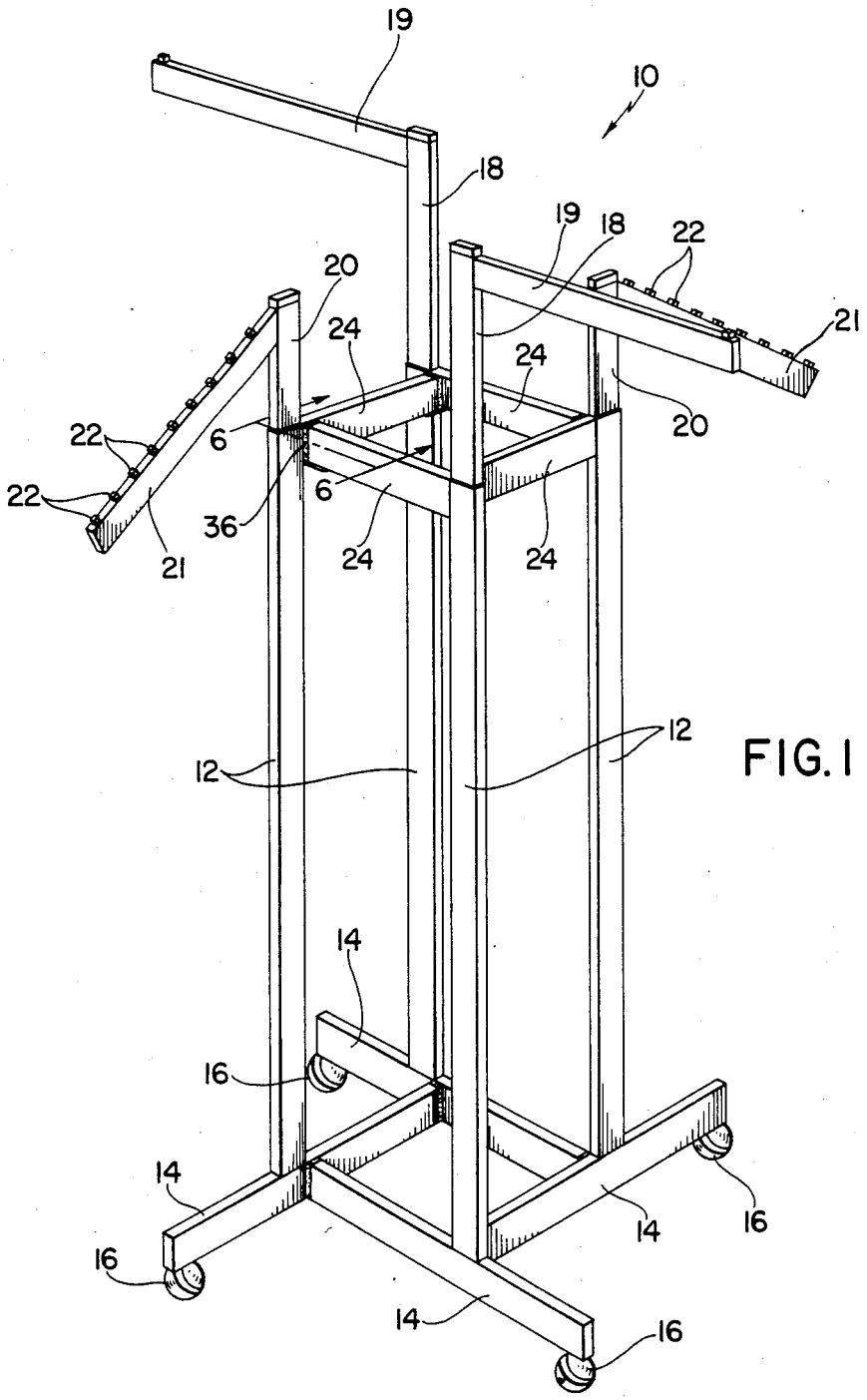
FIG. 1 is a perspective view of the preassembled foldable display rack embodied in the subject invention and as illustrated in the set-up open display position.

Referring now to the drawings and particularly to FIG. 1, the display rack embodied in the subject invention is illustrated and is generally indicated at 10. As shown in FIG. 1, the display rack 10 is of that type that is designed to receive articles for display thereon such as garments, and are normally utilized in retail establishments, such as men's haberdashers or women's dress shops, or in corresponding locations in department stores. It will be understood from the description of the invention that follows hereinafter that the concept of the invention, whereby the preassembled component parts of the rack are movable from a fully folded position to an open display position in a matter of seconds, may be incorporated in other types of racks that are not necessarily used in the garment display field.

Referring again to FIG. 1, the display rack 10 includes a plurality of elongated vertical support members 12, each of which is formed of a tubular metal material having a cross section that is generally rectangular in configuration. Fixed to the lowermost end of each of the vertical support members 12 is an elongated horizontal foot member 14 on the underside of which a caster 16 is mounted to provide for mobility of the display rack 10 as required. As will be described, the preassembled rack 10 is designed to be movable from the folded closed position to a setup display position and the movement of the preassembled component parts of the rack to the display position is accomplished without the use of any conventional fasteners or tooling that have been normally utilized heretofore in the assembly of display racks of the general type embodied in the subject invention.

Mounted for telescopic vertical movement within the support members 12 are elongated support rods 18 and 20 which, as shown, may also include either a horizontal support element 19 or an inclined support element 21. The inclined support elements 21 are provided with upstanding notches 22 for receiving hangers therebetween when a garment is to be mounted for display in vertical staggered relation, while support elements 19 which are horizontally disposed are designed to receive garment hangers thereon in the straight-line conventional manner. The support rods 18 and 20 are vertically adjustable within their respective tubular support members 12 to various vertical positions as required, it being understood that each of the support rods 18 and 20 may be positioned in a different vertical position relative to the others. Any suitable lock means may also be incorporated within the display rods 18 and 20 for locking each of the support rods in a required vertical display position.

Figure 7:
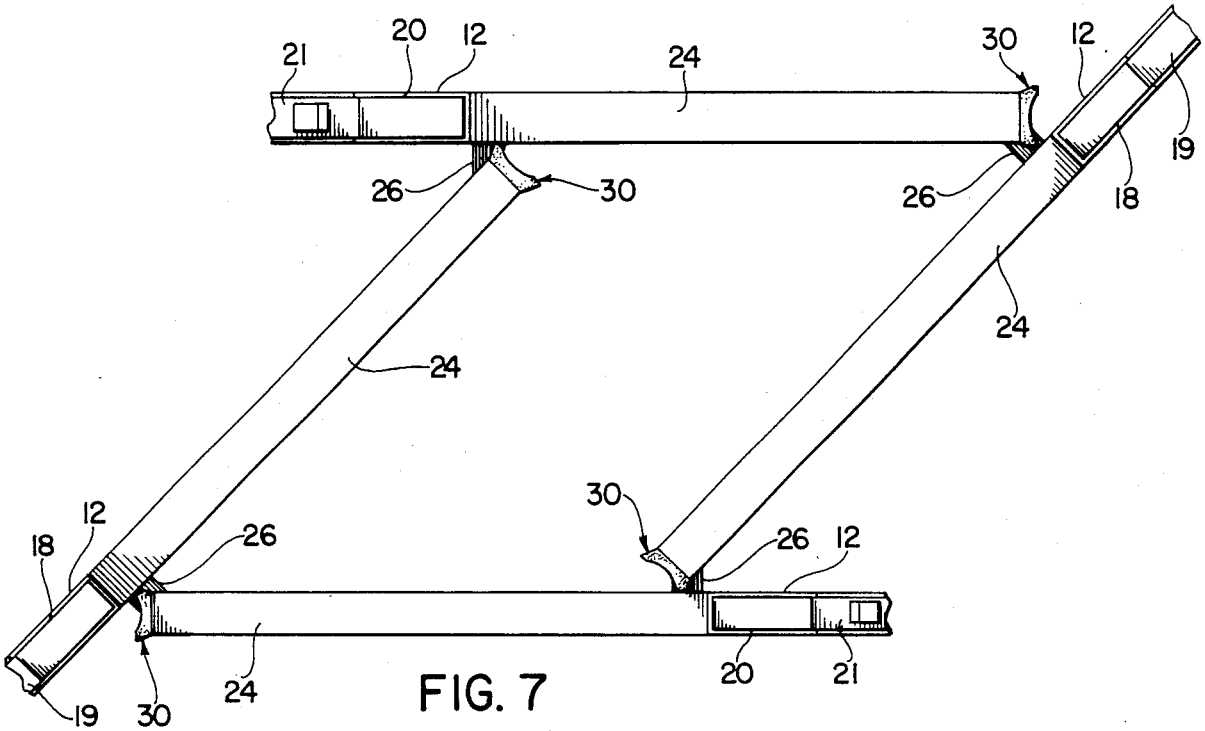
FIG. 7 is a top plan view of the rack as shown in the partially open position corresponding to the position illustrated in FIG. 3.
Figure 8:
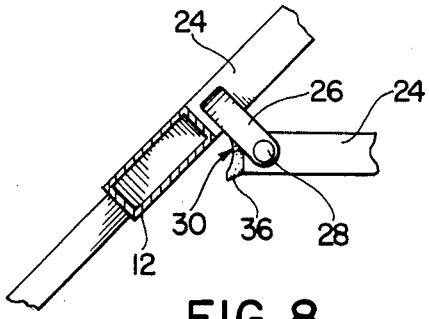
FIG. 8 is an enlarged view of portions of the underside of adjacent cross members illustrating the pivotal connection therebetween.

As previously described hereinabove, the preassembled display rack 10 of the subject invention is assembled without the use of any conventional fasteners, bolts or the like, and is moved from a knocked-down or folded position to a set-up display position in a simple maneuver requiring only a very minimal exertion of force to effect the movement. In order to accomplish the movement of the component parts of the display rack 10 from the folded to the set-up display position, a plurality of cross members 24 are provided, each cross member 24 being mounted on an interior side wall of a support member, wherein each cross member 24 is dispsoed at right angles with respect to the support member 12 to which it is fixed. As shown more clearly in FIGS. 7–9, each cross member 24 is also pivotally connected to an adjacent cross member 24 by a lever 26. As shown in FIG. 8, each of the levers 26 is mounted on the underside of the cross member 24 to which it is fixed and is welded thereto. The opposite end of each lever 26 is pivotally connected to the adjacent cross member 24 through a pivot connection defined by a pin or rivet 28. Thus, it seen that each cross member 24 is located in spaced partial relation with respect to an opposed cross member, the spaced opposed cross member 24 forming a parallelogram in which the opposed cross members will retain their parallel relation regardless of the location thereof as the component parts of the rack are moved from the fully folded knocked-down position to the set-up open display position.

Figure 9:
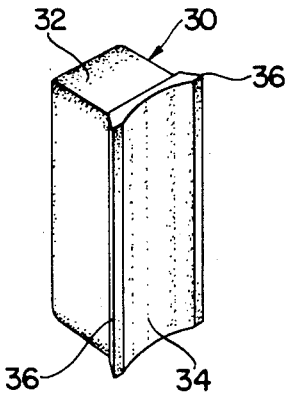
FIG. 9 is a perspective view showing a flexible pad of the type that is inserted into the cross members and that is provided for locking the component parts of the rack in the open display position.

In order to lock the support members 12 in the open position thereof as shown in FIG. 1, a flexible pad generally indicated at 30 in FIG. 9 is provided. The flexible pad 30 is formed of a rubber-like material and includes a body 32 on which a front portion 34 is formed having a generally concave configuration that is bordered by projecting edges 36. The body 32 of the flexible pad 30 has a rectangular cross sectional configuration that is dimensioned to be frictionally received within the tubular open free end of the cross member 24 in which it is inserted, the front portion 34 of the pad 30 projecting outwardly of the free end of each of the cross members 24 to expose the edges 36 thereof. The edges 36 thus prevent the body 32 to which they are joined from being forced inwardly into its cross member during the unfolding of the rack.

It is understood that the foot members 14 that are joined to the lowermost end of the support members 12 also receive pads similar to the pads 30 in the open free ends thereof that are located opposite to the ends on which the casters 16 are mounted. Also, end of the foot members 14 is pivotally connected to an adjacent foot member through a pivot connection similar to that described above and illustrated in FIG. 8.

Figure 3:
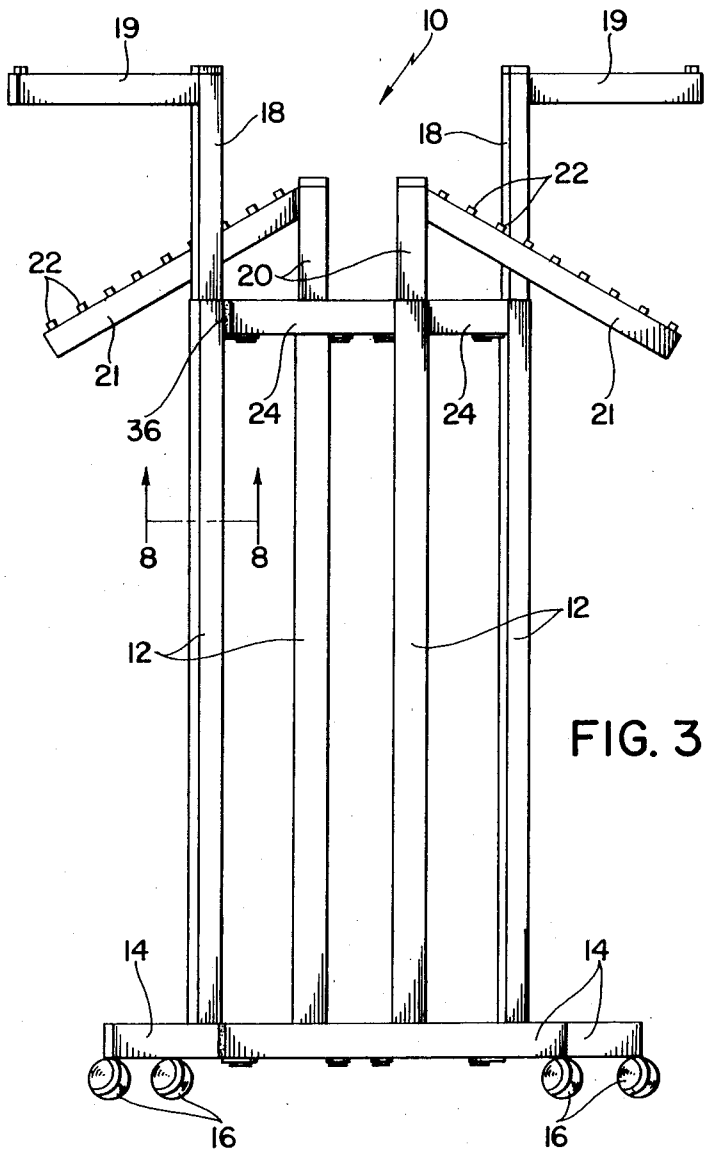
FIG. 3 is an elevational view similar to FIG. 2 but showing the rack in a partially opened position.
Figure 2:
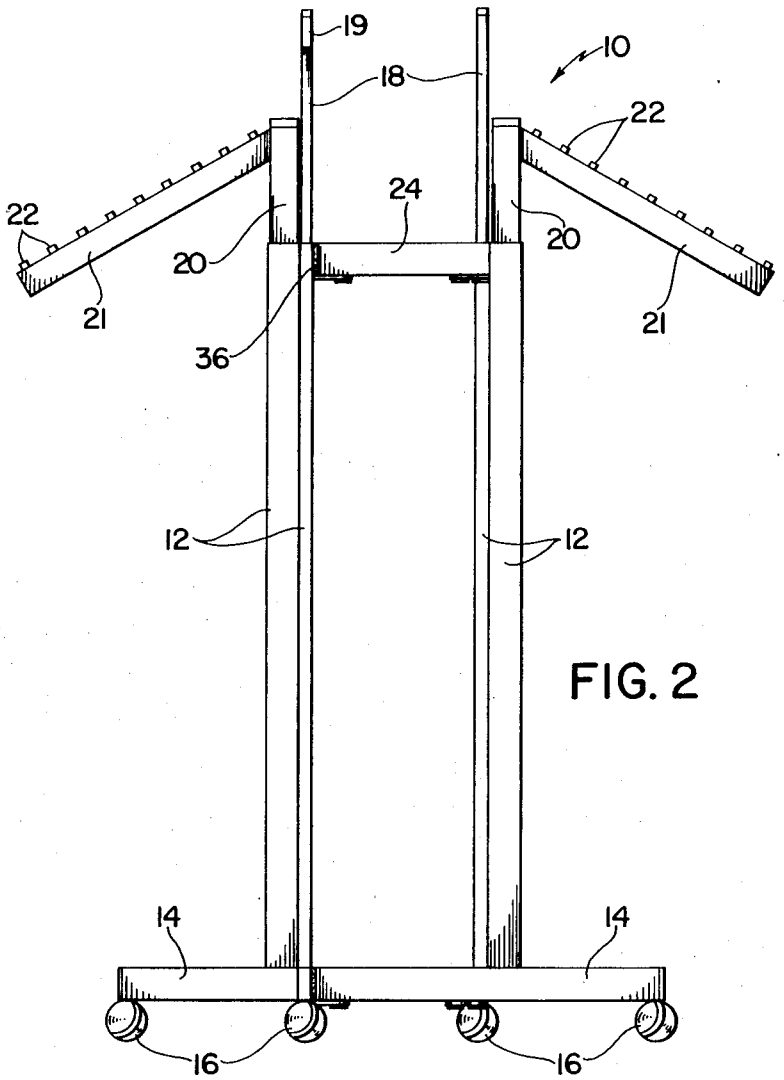
FIG. 2 is an elevational view of the rack illustrated in FIG. 1.
Figure 4:
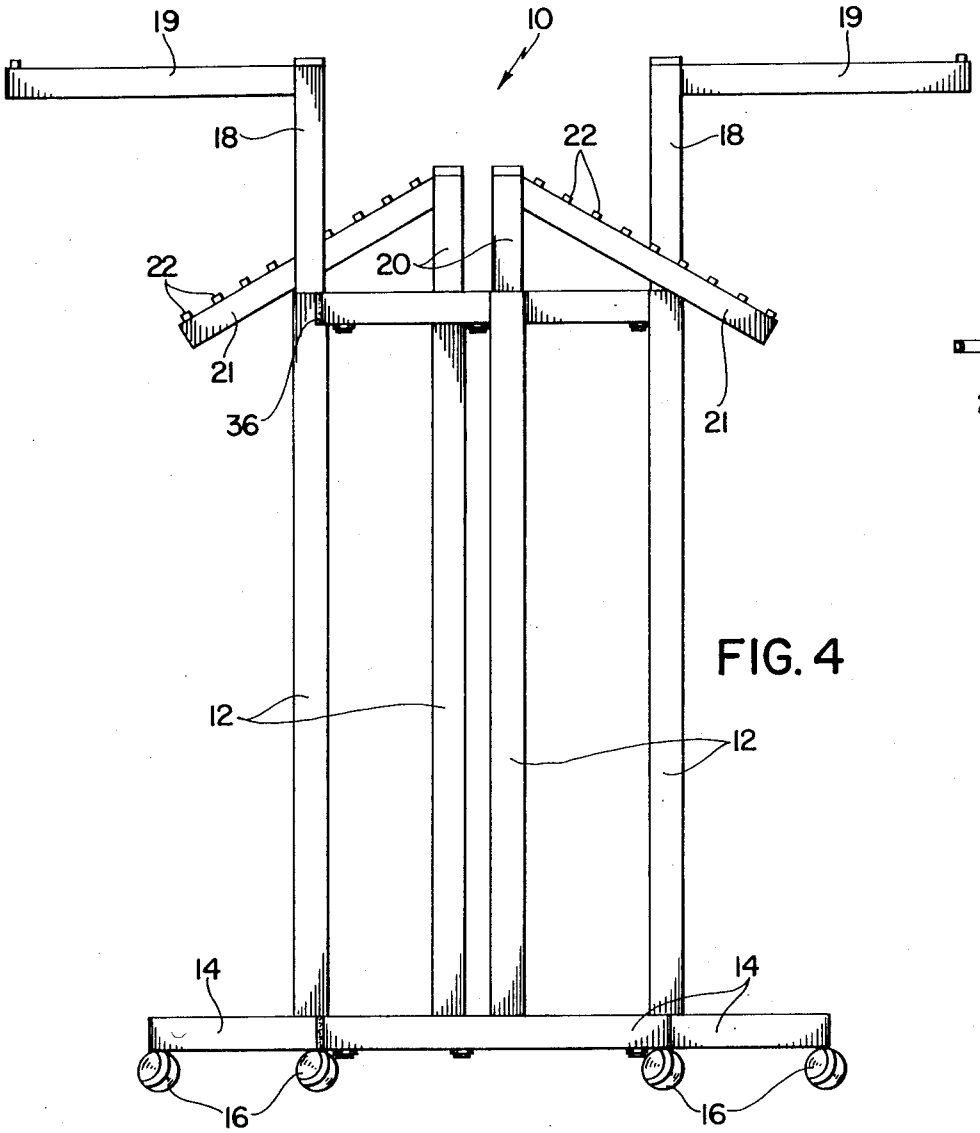
FIG. 4 is an elevational view similar to FIGS. 2 and 3, but illustrating the rack in the fully closed and folded position.

In the knocked-down or folded position of the display rack 10, all of the cross members 24 and foot members 14 have been pivotally moved so that the side walls of the cross members are disposed in generally parallel relation as shown in FIG. 4. In this position, the resilient pads 30 are removed from contact with an adjacent cross member 24 or foot member 14, although the support members 12 are still interconnected to each other through the cross members 24 by the pivot levers 26. When it is desired to move the display rack to the set-up display position thereof, a pair of adjacent support elements 19 and 21 that are secured to the support rods 18 are grasped and 20 and moved outwardly away from each other in a swinging motion, thereby causing the upper cross members 24 and lower foot members 14 to pivot relative to each other toward the position as shown in FIGS. 3 and 7. FIGS. 3 and 7 thus illustrate the component parts of the rack in partially open position with the edges 36 of the resilient pads 30 beginning to make contact with the surfaces of the adjacent cross members and foot members. As the support elements 19 and 21 are further urged away from each other, the cross members 24 and foot members 14 are pivotally moved such that the resilient pads 30 are snapped over the edges 36 thereof to locate the front portions 34 of the pads in flush contact with the adjacent surfaces of the cross members and foot members. Since the levers 26 are now located directly beneath the cross members to which they are pivotally connected, the center position thereof is reached and the resilient pads 26 frictionally retain the cross members and foot members in the open position in locked relation. It is seen that the centering torque exerted by the pads at the contact areas as defined by the concave front portions of the pads locates the cross members 24 and the foot members 14 in the locked open position.

Figure 5:
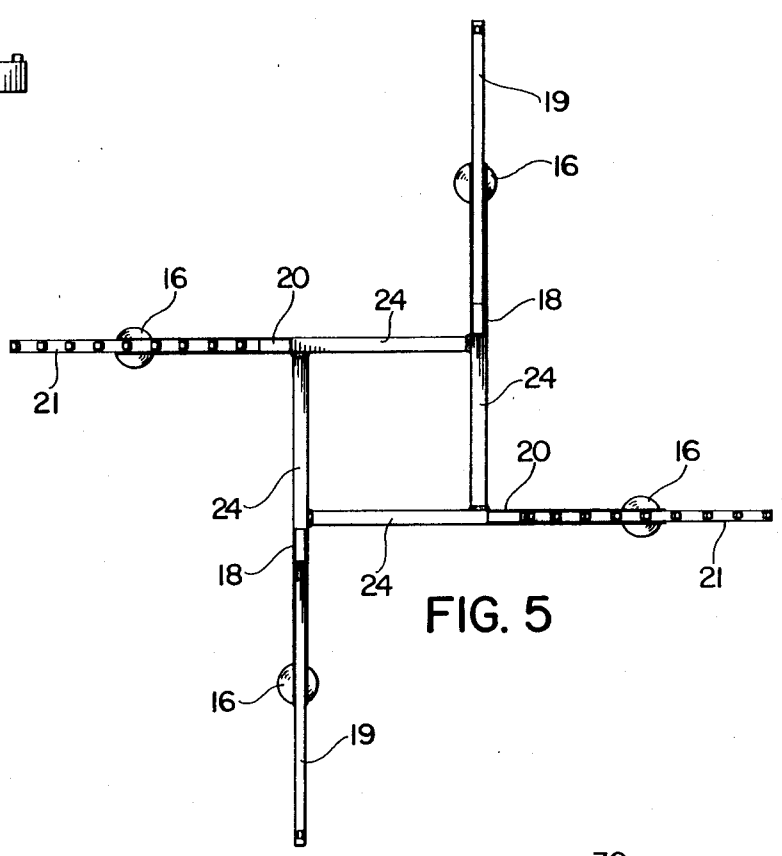
FIG. 5 is a top plan view of the open rack as shown to FIGS. 1 and 2.
Figure 6:
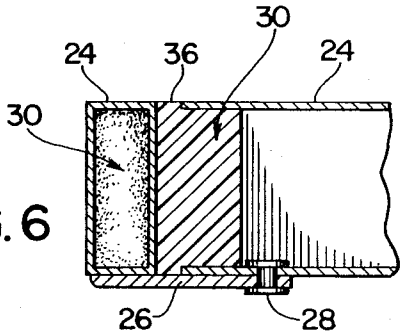
FIG. 6 is a sectional view taken along line 6—6 in FIG. 1.

The movement of the rack from the knock-down folded position to the set-up display position is accomplished in a matter of seconds, since it is only necessary to urge the support elements 19 and 21 of the elongated support rods 18 and 20 in a direction away from each other, thereby causing the cross members 24 and foot members 14 to pivot in the manner as described to the position as shown in FIG. 5. Conversely, the rack is moved from the set-up open display position to the folded closed position with relatively little effort, it only being necessary that the adjacent elements 19 and 21 of the rods 18 and 20 be moved inwardly toward each other to urge the pads 30 out of contact with the adjacent cross members 24 and foot members 14, whereafter the cross members and foot members are moved to the folded position as shown in FIG. 4.

It is seen that the assembled folded display rack as embodied in the subject invention is unique in the manner of use thereof in that it can be moved to the unfolded displaced position without the use of any external fasteners, bolts or the like, and is positively retained in the display position after movement thereto in the required manner. The rack is completely portable since it is mounted on the casters 16, and it has versatility in that various kinds of display support rods can be mounted in telescoping relation in the support members 12. The flexible pads 30 are relatively simple in construction and are positively retained in place within the open free ends of the cross members, but should any of the pads 30 wear or become dislodged, they can be easily replaced with similar pads. The pivot connection of each of the cross members to an adjacent cross members is substantially fail-proof, since the pivot lever 26 is welded to a cross member 24 and is connected to the adjacent cross member by a durable pivot pin or rivet.

While there is shown and described herein certain specific structure embodying the invention, it will be manifest to those skilled in the art that various modifications and rearrangement of the parts may be made without departing from the spirit and scope of the underlying inventive concept and that the same is not limited to the particular forms herein shown and described except insofar as indicated by the scope of the appended claims.

What is claimed:

1. An assembled, foldable display rack that is movable to and from an open display position and a folded position without the assembly or disassembly of any of the component parts thereof, comprising a plurality of vertical support members, each of which has a display member located at the upper end thereof and foot member located at the lower end thereof, a horizontal cross member fixed to each of said support members at the upper end thereof and extending at right angles with respect thereof, each of said cross members including an end that is fixed to a vertical support member and a free end that is located opposite to the fixed end thereof, said free end being pivotally connected to an adjacent cross member in close relation to the fixed end thereof, and a resilient pad mounted in the pivotal free end of each of said cross members, said cross members being pivotally movable from a folded position wherein said pads are located in nonengaging relation with respect to an adjacent cross member to an open display position wherein each of said pads is disposed in frictional engaging relation with respect to the adjacent cross member to lock said cross members in the open display position, in which position each cross member is disposed at right angles relative to an adjacent cross member.

2. An assembled, foldable display rack as claimed in claim 1, each of said foot members being pivotably connected to an adjacent vertical support member, and being disposed in parallel spaced vertical relation with respect to a cross member that is fixed to the vertical support member to which the foot member is secured, said foot members being movable with said vertical support members to the open display position to form a base for said vertical support members on which articles are mounted for display.

3. An assembled, foldable display rack as claimed in claim 2, a flexible pad mounted in an end of each of said foot members adjacent to the pivotal connection thereof, each of said pads being movable into and out of frictional engagement with an adjacent foot member and supplementing the frictional contact of the pads as located in said cross members with an adjacent cross member to lock said support members in the open display position thereof.

4. An assembled, foldable display rack as claimed in claim 1, each of said support members being tubular in construction and receiving a support element in sliding telescoping relation therein, wherein each of said support elements is movable to a desired vertical position relative to the support member in which it is received, said support elements recieving articles for display thereon so that said articles are displayable at various vertical positions.

5. An assembled, foldable display rack as claimed in claim 1, each of said pads simultaneously engaging an adjacent cross member and movable into frictional contact therewith as said cross members are moved to the open display position.

6. An assembled, foldable display rack as claimed in claim 1, said pivotally interconnected cross members defining a parallelogram in which oppositely-located cross members are disposed in parallel relation as said cross members are moved from the folded position to the open postion.

7. An assembled, foldable display rack as claimed in claim 6, the pivot connection for each cross member being defined by a lever that is fixed to a cross member on the underside thereof and that is pivotally connected to an adjacent cross member on the underside thereof.

8. An assembled, foldable display rack as claimed in claim 7, each of said levers being fixed to a cross member such that the longitudinal axis thereof is perpendicular to the longitudinal axis of the cross member, whereby each lever extends directly beneath and is aligned with the cross member it is pivotally connected to when the cross members are located in the open display position thereof.

9. An assembled, foldable display rack as claimed in claim 8, said levers being arranged such that the flexible pads engage the adjacent cross member in the open display position in offset relation with respect to a vertical support member to which the adjacent cross member is secured in fixed relation.

* * * * *